US006397836B1

(12) United States Patent
Pelletier et al.

(10) Patent No.: US 6,397,836 B1
(45) Date of Patent: Jun. 4, 2002

(54) DAMPED OVEN DOOR MOUNTING ASSEMBLIES

(75) Inventors: Thomas A Pelletier, Wallingford; Steven Levine, East Hampton; Gregory Tropea, New Britain; Kenneth Strickland, Glastonbury, all of CT (US)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 09/793,389

(22) Filed: Feb. 27, 2001

(51) Int. Cl.[7] ..... F23M 7/00

(52) U.S. Cl. ..... 126/194; 126/197; 49/386

(58) Field of Search ..... 126/191, 194, 126/197, 190, 198; 16/321, 322, 333, 334; 49/386, 387

(56) References Cited

U.S. PATENT DOCUMENTS

| | | | | |
|---|---|---|---|---|
| 2,124,349 A | | 7/1938 | Herbster | |
| 2,823,662 A | | 2/1958 | Aylor | |
| 3,072,117 A | | 1/1963 | Stoligrosz et al. | |
| 3,150,658 A | | 9/1964 | Ferland | |
| 3,286,706 A | | 11/1966 | Hoppe | |
| 3,299,879 A | | 1/1967 | Doner | |
| 3,327,701 A | | 6/1967 | Smith | |
| 3,450,125 A | | 6/1969 | Hopkins | |
| 3,838,538 A | | 10/1974 | Burford | |
| 3,889,654 A | | 6/1975 | Kauranen et al. | |
| 4,021,968 A | | 5/1977 | Kendall | |
| 4,269,165 A | | 5/1981 | Wrotny et al. | |
| 4,287,873 A | | 9/1981 | Goins et al. | |
| 4,665,892 A | * | 5/1987 | Spargo et al. | 126/194 |
| 4,817,240 A | * | 4/1989 | Sovis et al. | 126/194 |
| 4,927,995 A | | 5/1990 | Lovett et al. | |
| 5,025,776 A | | 6/1991 | Hanley et al. | |
| 5,822,925 A | * | 10/1998 | McKinney | 126/197 |
| 5,918,588 A | | 7/1999 | Gil Garcia | |

FOREIGN PATENT DOCUMENTS

| | | |
|---|---|---|
| DE | 29 39 727 | 4/1981 |
| EP | 0 269 134 | 6/1988 |

* cited by examiner

*Primary Examiner*—James C. Yeung
(74) *Attorney, Agent, or Firm*—Pillsbury Winthrop LLP

(57) ABSTRACT

A pair of door mounting assemblies mount an oven door assembly to an oven such that the oven door assembly may move between a closed baking position, a broiling position, and an open position. Each of the door mounting assemblies includes a mounting member that is pivotally connected to the door assembly. Each door mounting assembly includes a spring biased mechanism to enable the oven door assembly to be biased by the weight thereof when in a first range of movement, to be biased toward and into the broiling position when in a second range of movement, and to be biased toward and into the baking position when in a third range of movement. A damper assembly provides resistance to the movement of the oven door assembly within the second and third ranges to limit the rate of movement of the oven door assembly toward the broiling and baking positions.

24 Claims, 11 Drawing Sheets

DAMPED OVEN DOOR MOUNTING ASSEMBLIES

FIELD OF THE INVENTION

The present invention relates generally to ovens and, more particularly, to an oven with a damped oven door mounting assembly.

BACKGROUND OF THE INVENTION

Oven doors are generally constructed to be relatively rigid to facilitate forming an adequate seal about the heating chamber opening. Further, oven doors typically include various forms of insulation features, such as insulating materials and/or voids (e.g., dead air spaces) therein. Consequently, oven doors tend to be relatively bulky and heavy. To facilitate manual movement of the door, such as closing the door, (which requires moving the door from a generally horizontal position toward a vertical position, i.e., requiring the lifting of a substantial portion of the weight of the door) oven doors hinges often utilize a spring connected about the hinge to bias movement of the door relative to the oven in one direction, or the other, or both.

Such a hinge for an oven door is described in Leland, U.S. Pat. No. 3,450,125. Leland discloses a hinge for an oven door that allows the door to be moved between an open position, a closed position, and broiler stop position (partially open position adjacent closed position). Additionally, the hinge is provided with a spring to bias the door towards the closed position.

A hinge for an oven door, as described in Leland is advantageous since manual movement of the door is assisted via the spring. However, if not at least partially manually controlled, upon closing the spring biasing the door toward the closed position will generate excessive momentum causing the door to "slam" against the oven frame. Consequently, the door and oven frames are subject to fatigue and impact damage. More specifically, as the door swings toward the closed position about the hinge, the weight acting on the door decreases as the door becomes more vertically oriented. At a point prior to conventional (and operable) broiler stop positions, the spring force acting on the door towards the closed position overcomes the force (weight of the door) on the door acting towards the open position and effects movement of the door towards the closed position. As such, the spring increases the momentum of the closing door and "slams" the door against the oven frame. Even with an intermediate (broiler) stop provided, as with Leland, the spring driven momentum of the door, when manually uncontrolled through this range of movement, is sufficient to prevent stoppage at the intermediate stop and significantly impact the door against the oven frame. It is, of course, possible to manually move the door to the closed position and thereby prevent impact damage however, given inherent circumstances in a typical kitchen, it is often inconvenient at best for a user to commit a hand to closing the door.

Herbster (U.S. Pat. No. 2,124,349) discloses an oven door operating device that utilizes a spring to facilitate closing the door and a supposed "buffer" to decrease momentum of the door as it approaches the fully open and closed positions. This device is advantageous in that the door and oven are seemly protected from excessive impacts. However, the device poses several handicaps when presented with the current state of the art.

First, the device is foot controlled by way of a pair of pedals. This may prove useful in providing hands-free operation of the door, however significantly increases the force applied to the door and momentum thereof. Herbster's foot pedals seem to promote excessive force on the door, especially when moving into the extreme positions (opened and closed positions). To reduce instances of excessive impacts, Herbster provides a buffer to reduce the momentum of the door as it moves into the fully open and fully closed positions.

The device of Herbster is quite bulky and primarily mounted to the frame of the oven. While this arrangement effectively hides the device from view and hindrance, it requires substantial space within the oven frame to accommodate mounting of the device therein. Further, ovens of the type described in Herbster generally include a separate broiler portion. As such, Herbster makes no reference to supplying a broiler stop.

As stated previously, Herbster's device supplies a buffer to cushion the impacts of the door. As shown and described in Herbster, the buffer acts to resist motion in either direction of movement of the door (towards the open position and towards the closed position, corresponding to relative axial movement of the piston). As such, Herbster's device resists manual movement of the door, so as to increase the effort required to manually effect movement of the door, especially towards the open position, wherein the spring provides further resistance to movement.

Furthermore, Herbster's buffer, as shown and described, acts as a resilient spring in that the compression of air therein provides the resisting force of the damper. There is provided an inlet check valve at each end of the buffer to allow an inflow of air. As Herbster does not address the problem of the increasing volume of the piston arm within the cylinder as the piston moves downwardly, it is submitted that movement of the door toward the open position, corresponding to the downward movement of the piston within the buffer, will produce relatively greater resistive force than movement of the door toward the closed position. This is highly unfavorable since movement of the door toward the open position is further resisted by the spring. It is further submitted that since no outlet within the cylinder is provided, subsequent movements of the door will cause a pressure increase within the buffer due to the inability of air to escape the cylinder. When a relatively high pressure is reached within the buffer, the suction pressure produced will be insufficient to actuate the inlet valves. At this point, movement of the door toward the open position, corresponding to downward movement of the piston and an increasing volume of piston arm within the cylinder, will be substantially resisted, as the buffer would then act as a spring biasing the door toward the closed position.

SUMMARY OF THE INVENTION

The present invention avoids these limitations by providing an oven comprising an oven assembly, which defines an oven chamber within which heatable items can be heated and an access opening communicating with the oven chamber. An oven door assembly is mounted on the oven assembly for movement between a generally vertically extending closed baking operating position, a slightly inclined partially open broiling operating position, and a generally horizontally extending open position.

The oven door assembly defines substantially enclosed restricted spaces within opposite ends thereof, within which a pair of horizontally spaced door mounting assemblies extend. Each of the door mounting assemblies include a mounting member extending from an associated space and are detachably fixedly secured to the oven assembly. Each of the door mounting assemblies are also pivotally connected to the door assembly enabling the door assembly to be pivotally moved with respect to the oven assembly between the operating positions and the open position thereof.

Each of the door mounting assemblies includes a spring biased mechanism within an associated space. The spring biased mechanisms are constructed and arranged to enable the oven door assembly to be moved by the weight thereof toward and into the open position thereof when in a first range of movement adjacent the open position. The spring biased mechanism also enables the oven door assembly to be biased toward and into the broiling position by the spring biased mechanism when in a second range of movement adjacent the broiling position thereof. Further, the spring biased mechanism enables the oven door assembly to be biased toward and into the baking position by the spring biased mechanism when in a third range of movement adjacent the baking position.

The oven includes a manually engagable structure on the oven door assembly, which is constructed and arranged to enable a user to manually control movement of the oven door assembly within all of the ranges.

The pair of door mounting assemblies includes a damper assembly within an associated space. The damper assembly is constructed and arranged to provide resistance to the movement of the oven door assembly within the second and third ranges to limit the rate of movement of the oven door assembly toward the broiling and baking positions.

In a preferred embodiment, substantially less resistance to the movement of the oven door assembly is provided toward the open position (away from the baking position) in comparison with the greater resistance to movement toward the baking position.

DETAILED DESCRIPTION OF THE INVENTION

Figure 1:
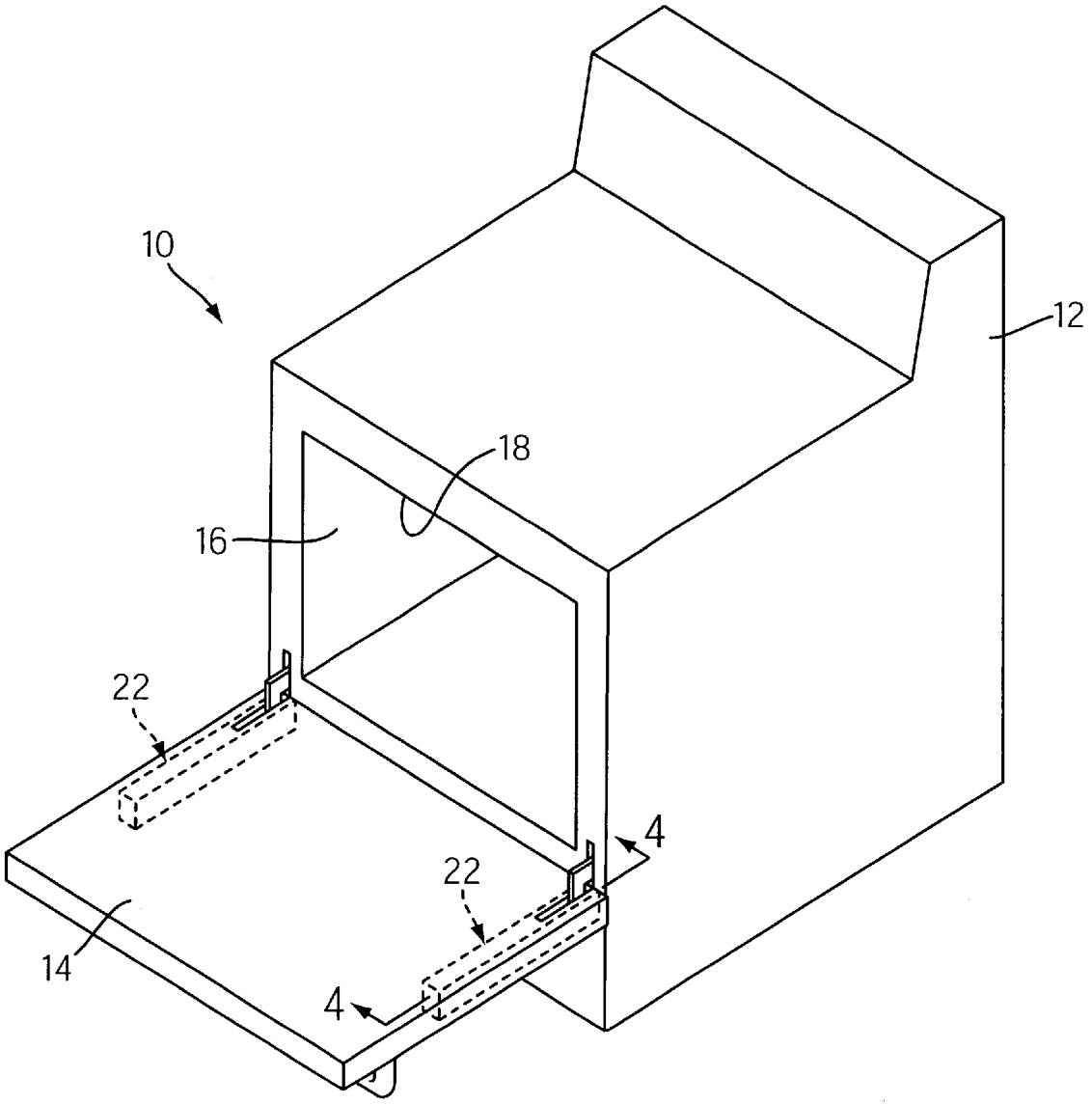
FIG. 1 is a perspective view of the oven embodying the principles of the present invention with the door assembly disposed in the open position showing the door mounting assemblies in phantom.

FIG. 1 shows an oven 10 embodying the principles of the present invention. The oven 10 includes an oven assembly 12 and an oven door assembly 14. The oven assembly 12 provides an oven chamber 16, within which heatable items can be heated, that is accessible by a user via an access opening 18 leading thereto. The oven door assembly 14 is pivotally mounted to the oven assembly 12, as will be further described herein, and is configured to be moveable between an open position (shown in FIG. 1), a open broiling operating position (shown in FIG. 2), and a closed baking operating position (shown in FIG. 3) with respect to the oven assembly 12.

Figure 4:
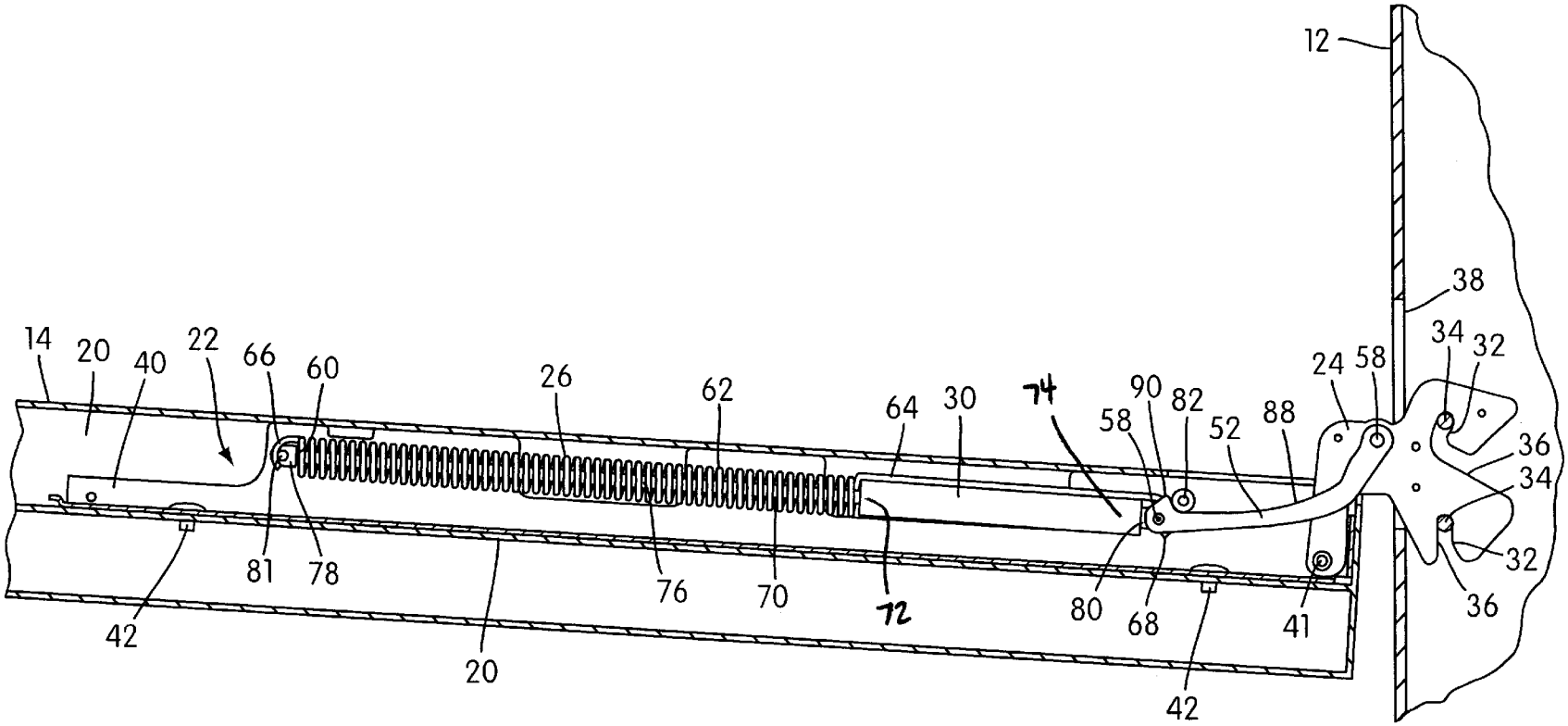
FIG. 4 is a sectional view of one of the door mounting assemblies taken along the line 4—4 in FIG. 1.

As shown in FIG. 4, the oven door assembly 14 has an interior that defines substantially enclosed restricted spaces 20 within opposite ends thereof. Specifically, as with most modem day ovens, the door assembly 14 is filled with insulation, and there is space provided therein towards opposite lateral ends thereof. A door mounting assembly 22 is disposed within respective restricted spaces 20, providing a pair of door mounting assemblies, which pivotally connects the door assembly 14 with the oven assembly 12. The space 20 within the door that receives the assembly is restricted to the opposite lateral ends of the door interior.

Shown in FIG. 4, each of the door mounting assemblies 22 includes a mounting member 24 extending from an associated restricted space 20 and detachably fixedly secured to the oven assembly 12. Further, each mounting member 24 is pivotally connected to respective door assemblies 14 enabling the door assembly 14 to be pivotally moved with respect to the oven assembly 12 into the open and operating positions thereof.

FIG. 4 also shows each of the door mounting assemblies 22 including a spring biased mechanism 26 within an associated space 20. The spring biased mechanism 26 allows the oven door assembly 14 to be biased by its own weight toward and into the open position when the oven door assembly 14 is in a first range of movement adjacent the open position. The spring biased mechanism 26 biases the door assembly 14 toward and into the broiling position when the door assembly 14 is in a second range of movement adjacent the broiling position. Further, the spring biased mechanism 26 biases the oven door assembly 14 toward and into the baking position when the door assembly 14 is in a third range of movement between the broiling and baking positions.

Figure 3:
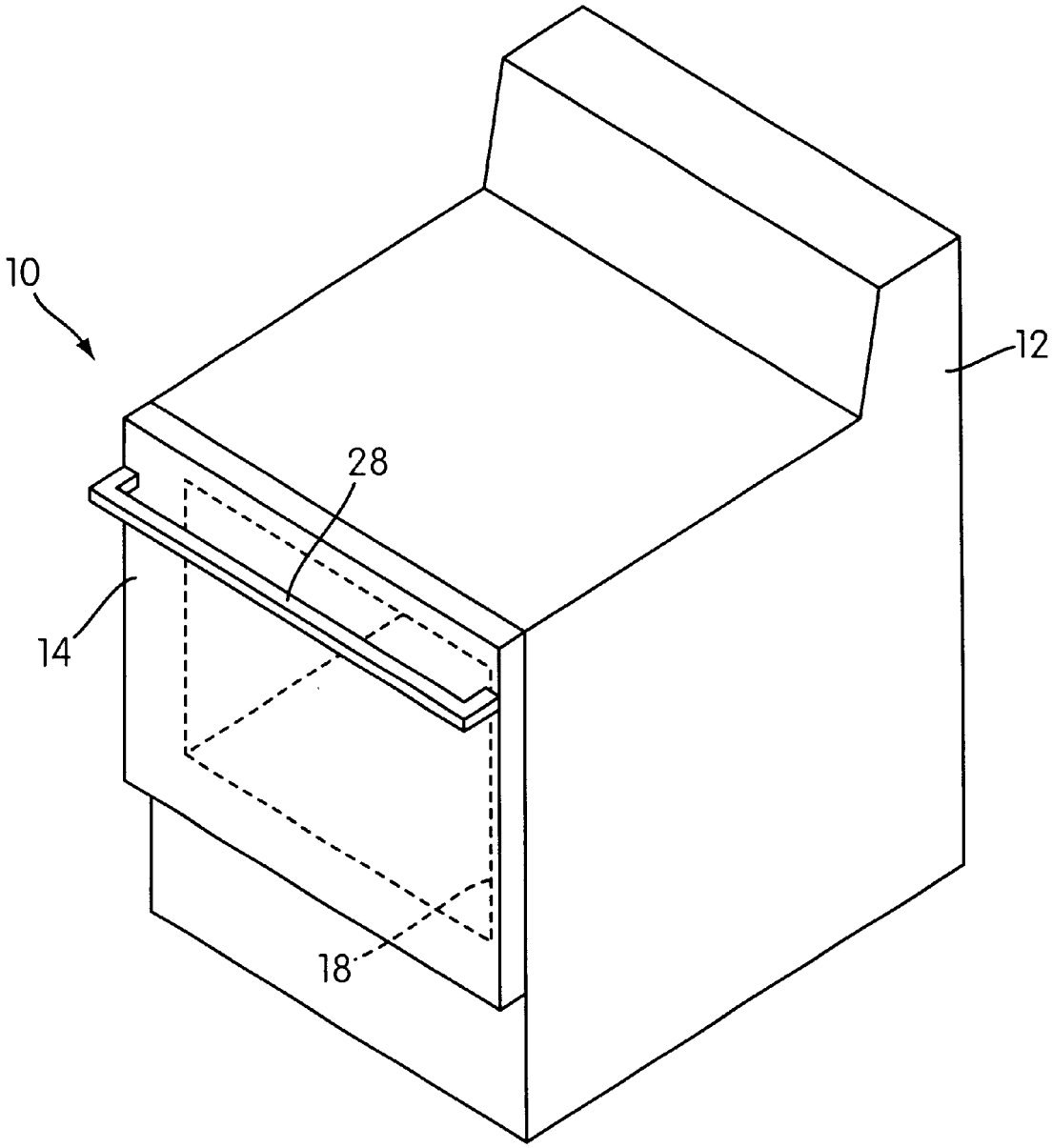
FIG. 3 is a perspective view of the oven shown in FIG. 1, with the door assembly disposed in the closed baking position.

The oven door assembly 14 also includes a manually engagable structure, or handle, 28, shown in FIG. 3, on an outer surface thereof. The manually engagable structure 28 enables a user to manually control movement of the oven door assembly 14 within all of the ranges.

Referring back to FIG. 4, the pair of door mounting assemblies 22 includes a damper assembly 30. The damper assembly 30 is disposed within an associated restricted space 20 and is constructed and arranged to provide resistance to the movement of the oven door assembly 14 within the second and third ranges of movement to limit the rate of movement of the oven door assembly 14 into the broiling and baking positions by manual movement of under the bias of the spring biased mechanism 26 allowed as a result of the release of manual control. The damper assembly 30 is further constructed and arranged to also provide resistance to the movement of the oven door assembly 14 in a direction toward and into the open position. Preferably, the damper assembly 30 provides substantially less resistance to door movement toward and into the open position in comparison to the resistance it provides within the third range of movement toward and into the baking (or closed) position.

As shown in FIG. 4, the oven door assembly 14 includes the spaces 20 in which the door mounting assemblies 22 are disposed. FIG. 4 shows the mounting member 24 being detachably fixedly secured to the oven assembly 12. The mounting member 24 includes a plurality of connecting portions 32 that are engagable with a respective plurality of connecting members 34 of the oven assembly 12. As shown, the connecting portions 32 form a series of grooves 36 within the mounting member 24 that provide a pathway for the connecting members 34 (may be in the form of horizontally extending pin elements, threaded fasteners, or the like) to slidably engage therewith. Terminal ends of the grooves 36 engage respective connecting members 34 thereby allowing the transfer of load (weight of the door, etc.) therefrom to the oven assembly 12. A slot opening 38 (see FIG. 1) within the oven assembly 12 allows the mounting member 24 to pass therethrough and engage the connecting members 34 with the grooves 36. As such, the user may disengage the door assembly 14 from the oven assembly 12 by lifting upwardly on the door assembly 14 and then pulling outwardly on the door assembly 14. The detachable nature of the door assembly 14 facilitates activities such as cleaning the oven chamber 16 (or the door assembly itself) or repairing/maintaining the oven assembly 12.

Each door mounting assembly 22 also includes a door mounting structure 40. The door mounting structures 40 are elongated members that are fixedly secured to the oven door assembly 14 within associated restricted spaces 20. One end of each door mounting structure 40 is pivotally connected to a respective mounting member 24. As shown in FIG. 4, a pivotal pin connection 41 may be utilized to pivotally connect the door mounting structure 40 with the mounting member 24. It is also contemplated that a pivotal threaded fastener connection (such as a bolt and nut) may be substituted for the pin connection 41. It is noted that any other suitable hinge or pivotal type connection may alternately be used to connect the mounting member 24 with the door mounting structure 40. The door mounting structure 40 is mounted to the door assembly with, for example, a plurality of threaded fasteners 42 that pass through openings within the door mounting structure 40 and threadedly engage with the oven door assembly 14 or cooperating fastening devices (such as nuts). It is noted that threaded fasteners may also be provided that pass through openings within the oven door assembly 14 and threadedly engage with the door mounting structure 40 or cooperating fastening devices (such as nuts). As can be seen in FIGS. 1 and 4, the door mounting structures 40 are substantially entirely disposed within associated restricted spaces 20. As such, the door mounting structures 40 are unexposed and concealed, which provides both an aesthetically pleasing appearance and presents a convenient out-of-the-way configuration. Additionally, the door mounting structures 40 are relatively protected from dirt, grease, and heat contamination. Further, this arrangement allows for a slim (space-saving) design of the oven assembly 12, since only the mounting members 24 engage therewith.

Figure 5:
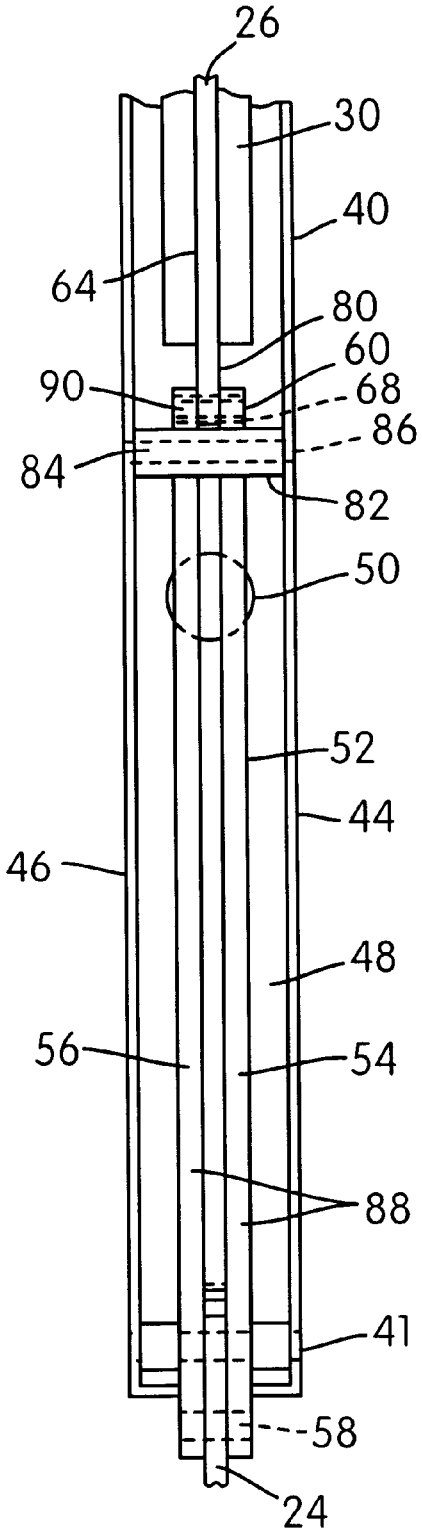
FIG. 5 is a partial top plan view of the door mounting structure, as indicated by line 5—5 in FIG. 8A.
Figure 6:
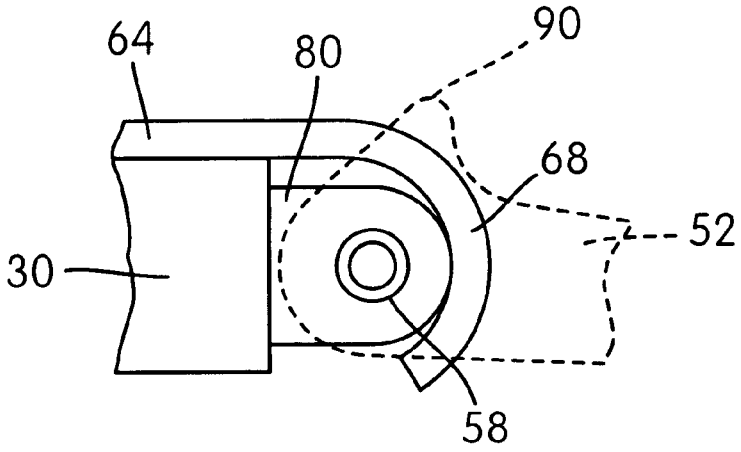
FIG. 6 is a partial side view of the connection of the damper assembly and spring biased mechanism with the connecting structure, showing the connecting structure in phantom.

As illustrated in FIGS. 5 and 6, each of the door mounting structures 40 may be in the form of a channel, or u-shaped member, with a pair of parallel upstanding walls 44, 46 that extend from a base portion 48. The base portion 48 provides openings 50, through which the threaded fasteners may pass to secure the door mounting structure 40 to the door assembly 14. Further, the pivotal connection 41 is accomplished by laterally oriented pin connector (or other suitable connector) through the upstanding walls 44, 46 and is secured thereto. As such the pivotal connection 41 is provided transverse to the length of the door mounting structure 40. Further, the U-shaped configuration of the door mounting structure 40 provides resiliency thereto.

Each door mounting assembly 22 further includes a connecting structure 52 that is pivotally connected to the mounting member 24 on one end thereof. An opposite end of the connecting structure 52 is pivotally connected to a first end of the damper assembly 30 and the spring biased mechanism 26. As shown in FIG. 5, the connecting structure 52 may include split portions 54 and 56. The split portions 54, 56 are disposed on respective sides of the mounting member 24 and are coaxially (relative to each other) pivotally connected to the mounting member 24 by pivotal connection 58 on the one end and to the damper assembly 30 by the pivotal connection 60 on the opposite end thereof. Similarly to the pivotal connection 41, the pivotal connections 58, 60 may be in the form of pin connections. The split portions 54, 56 are in parallel, spaced relation to each other, with the mounting member 24 and damper assembly 30 disposed therebetween at respective ends thereof. As such, the connecting structure 52 applies equivalent force to both transverse sides of the mounting member 24 and the damper assembly 30, effectively limiting torsional stress/strain of these elements by unequal transverse loading by the connecting structure 52 (as would be present in an off-center configuration wherein the connecting structure 52 is connected to one side of the mounting member/damper assembly). Further, pin fasteners or threaded fasteners associated with each of the pivotal connections 58, 60 are subjected to double-shear, in which there are two shear planes (coinciding with planes defined by abutting surfaces of the split portions 54, 56 and the damper assembly/mounting member) within each pin that are subjected to load on the connecting structure 52. Double-shear is an advantageous characteristic of this configuration since each shear plane carries only half the total load on the pin. As such, smaller pin diameters are possible than with configurations that call for single shear conditions (such as with an off-center connection).

FIG. 4 also shows the spring biased mechanism 26 and the damper assembly 30. As shown, the spring biased mechanism 26 includes an elongated cylindrically configured coiled tension spring body 62. The spring biased mechanism 26 further includes an extending portion 64 and provides connecting structure 66, 68 at respective ends thereof. The extending portion 64 extends longitudinally from one end of the spring body 62. The connecting structure 66, 68 may be formed by upturning a portion of the spring body and extending portion 62, 64, respectively to form hook-like structures. The connecting structure 68 forms the portion of the spring biased mechanism 26 that is connected to the connecting structure 52, and specifically, pivotal connection 58 thereof. The cylindrical arrangement of the tension spring body 62 is such that a longitudinally extending opening 70 is formed therethrough by coils thereof. The opening 70 has a relatively smaller diameter than an outer diameter of the tension spring body 62. It is contemplated that the tension spring body 62 and extending portion 64 may be formed of a metallic material suitable for use as a spring, such as described herein.

Figure 7:
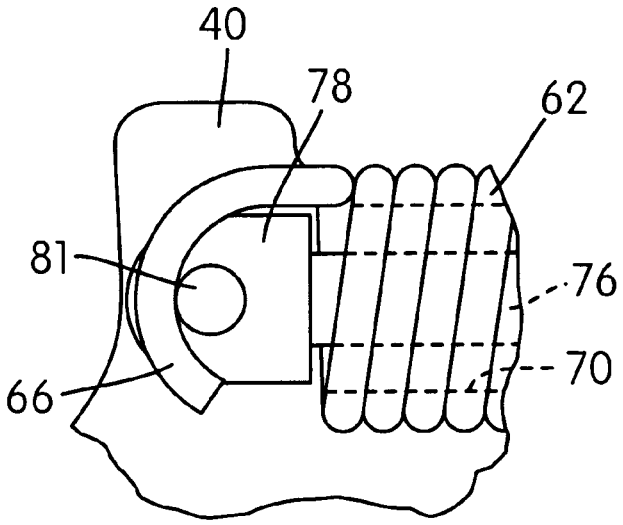
FIG. 7 is a partial side view of the connection of the damper assembly and spring biased mechanism with the door mounting structure.

As shown in FIG. 4, the damper assembly 30 includes a cylindrical damper 72. The damper 72 includes a damper body 74 and a longitudinally (relative to the damper body 74) extending piston arm 76 (may also be referred to as a piston or damper rod) telescopically extendable therefrom. The damper 72 further includes connecting structure 78, 80 at respective ends thereof. The connecting structure 80 is affixed to one end of the damper body 74 opposite the piston arm 76 and is connected to the connecting structure 52 by the pivotal connection 58, as shown in FIG. 7. The connecting structure 78 is affixed to one end of the piston arm 76 opposite the damper body 74 and is connected to the door mounting structure 40 via a pin connector 81, as shown in FIG. 8. As further shown in FIG. 7, the connecting structure 68 of the spring biased mechanism 26 may be configured so as to securely engage an outer periphery of the connecting structure 80 about the pivotal connection 58. As shown, the connecting structure 68 partially wraps around the connecting structure 80. In this arrangement, the connecting structures 68, 80 of the spring biased mechanism 26 and damper assembly 30 respectively, may be accommodated between the split portions 54, 56 of the connecting structure 52, as shown in FIG. 6. It is also contemplated that the connecting structure 68 may be directly engaged with the pivotal connection 58, such as by partially wrapping therearound. Referring to FIG. 8, the connecting structure 78 on the piston arm 76 is pivotally connected to the door mounting structure 40 via the pin connector 81. As shown, the connecting structure 66 is also engaged with the pin connector 81. As such, the damper assembly 30 and the spring biased mechanism 26 are each connected at their ends at similar respective points.

The damper 72 is used to damp movement of the door assembly 14 relative to the access opening 18. It is contemplated that the damper body 74 may have various constructions, which are known in the art, to achieve the desired damping characteristics herein described. For example, a hydraulic damper is known that is capable of producing damping force corresponding to a rate of movement of the piston arm 76 into the damper body 74. Another type of damper contemplated is a pneumatic damper, which has similar characteristics as its hydraulic counterpart.

In accordance with another aspect of the invention, a single-acting type dampers (of either hydraulic or pneumatic nature) are preferred. A single-acting damper is one in which a substantial damping force may be produced for only one direction of piston arm travel, while in the other direction, minimal resistance is provided. In the illustrated embodiment, damper 72 is a single-acting damper and is configured and positioned to produce damping force for rates of movement of the door assembly 14 in the direction toward the closed position (such as from the open position or broiling position). Movements of the door assembly 14 toward the open position corresponding to extension of the piston arm 76 out of the damper body 74) are substantially unresisted. This arrangement effectively limits the manual force required to move the door toward/into the open position (such as from the broiling position or closed position), since the damper 72 provides an insignificant resistance to door movement in this direction, while protecting the door assembly/oven assembly from impact and/or fatigue damage by limiting the momentum build-up of the door assembly 14 toward the broiling and closed positions.

It is further contemplated that only a single damper of the type herein contemplated may be required to sufficiently damp the movement of the door assembly. Consequently, it is possible to include the damper assembly 30 in only one of the pair of door mounting assemblies 22. However, it may be preferable to include a damper assembly 30 within each of the door mounting assemblies 22.

As further shown in FIG. 4, a roller element 82 is mounted to the door mounting structure 40 between the upstanding walls 44, 46. The roller element 82 may include a journal member 84 that is rotatably mounted on a pin connector 86 (see FIG. 6). As shown in FIG. 4, the journal member 84 is configured and positioned to rollingly engage a slide surface 88 of the connecting structure 52 (split portions 54, 56). The connecting structure 52 includes an outwardly protruding portion, or stop member 90 that is engagable by the roller element 82, as described below. The connecting structure 52 also includes a detent, or catch portion 92 that is engagable by the roller element 82, as described above.

Shown in FIG. 5, the upstanding walls 44, 46 of the door mounting structure 40 define a lateral extent of the door mounting assembly 22. In other words, the various components of the door mounting assembly 22, such as spring biased mechanism 26, damper assembly 30, connecting structure 52, and mounting member 24 are disposed within a laterally-extending space provided between the upstanding walls 44, 46. Further, shown in FIG. 4, the damper assembly 30 and the spring biased mechanism 26 are configured and arranged relative to each other such that the piston arm 76 extends within and through the inner periphery of the tension spring body 62. In other words, the piston arm 76 is disposed within the longitudinally extending opening 70 formed by the coils of the tension spring body 62. As such, a compact arrangement of the damper assembly 30 and spring biased mechanism 26 is possible between the upstanding walls 44, 46.

While the compact arrangement described above is preferred, it is within the broader aspects of the present invention to mount the damper assembly 30 and the spring biased mechanism 26 in side-by-side parallel relation with one another. In the parallel arrangement, either the damper assembly 30 or the spring biased mechanism 26 is positioned within the channel of the door mounting structure 40 and the other is positioned outwardly of the channel. For the outwardly positioned unit, the fasteners of the pivotal connections 58, 60 would be extended axially through openings in one of the adjacent upstanding walls 44, 46. The opening in the upstanding wall 44, 46 for the movable pin would be elongated to accommodate the movement.

OPERATION

Figure 2:
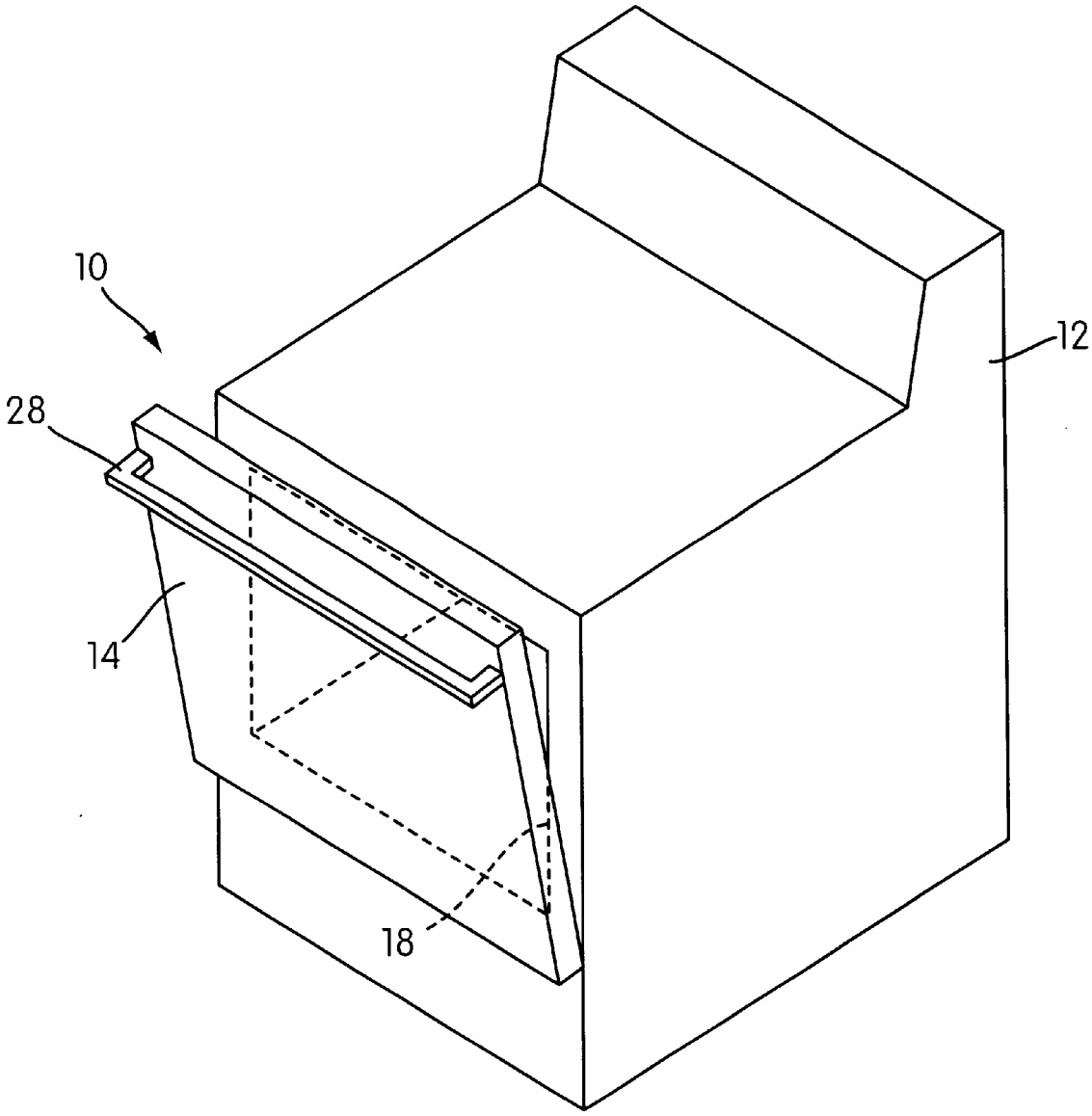
FIG. 2 is a perspective view of the oven shown in FIG. 1, with the door assembly disposed in the broiling operating position.

FIGS. 1–3 illustrate the open, the partially open broiling operating, and the closed baking operating positions that are possible with the oven 10 of the present invention. As shown in FIG. 4, the spring biased mechanism 26 and damper assembly 30 are disposed in generally fully extended configurations (i.e., maximum deflections obtained through the ranges of movement of the oven door assembly 14; not necessarily equivalent to maximum possible extensions of the damper assembly and spring biased mechanism) when the door assembly 14 is in the open position. Specifically, the tension spring body 62 and piston arm 76 are extended to maximum deflection positions. Further, in the open position, the journal member 84 abuts stop member 90 on the connecting structure 52 to restrict further pivotal movement of the door assembly 14 past the open position. As such, a spring force Fs is produced that acts generally longitudinally with respect to the tension spring body 62. The configuration of the connecting structure 52 and the journal member 84, as well as the cooperation therebetween, manipulates the spring force Fs to generate a torque Ti about the pivotal connection 41.

Figure 8A:
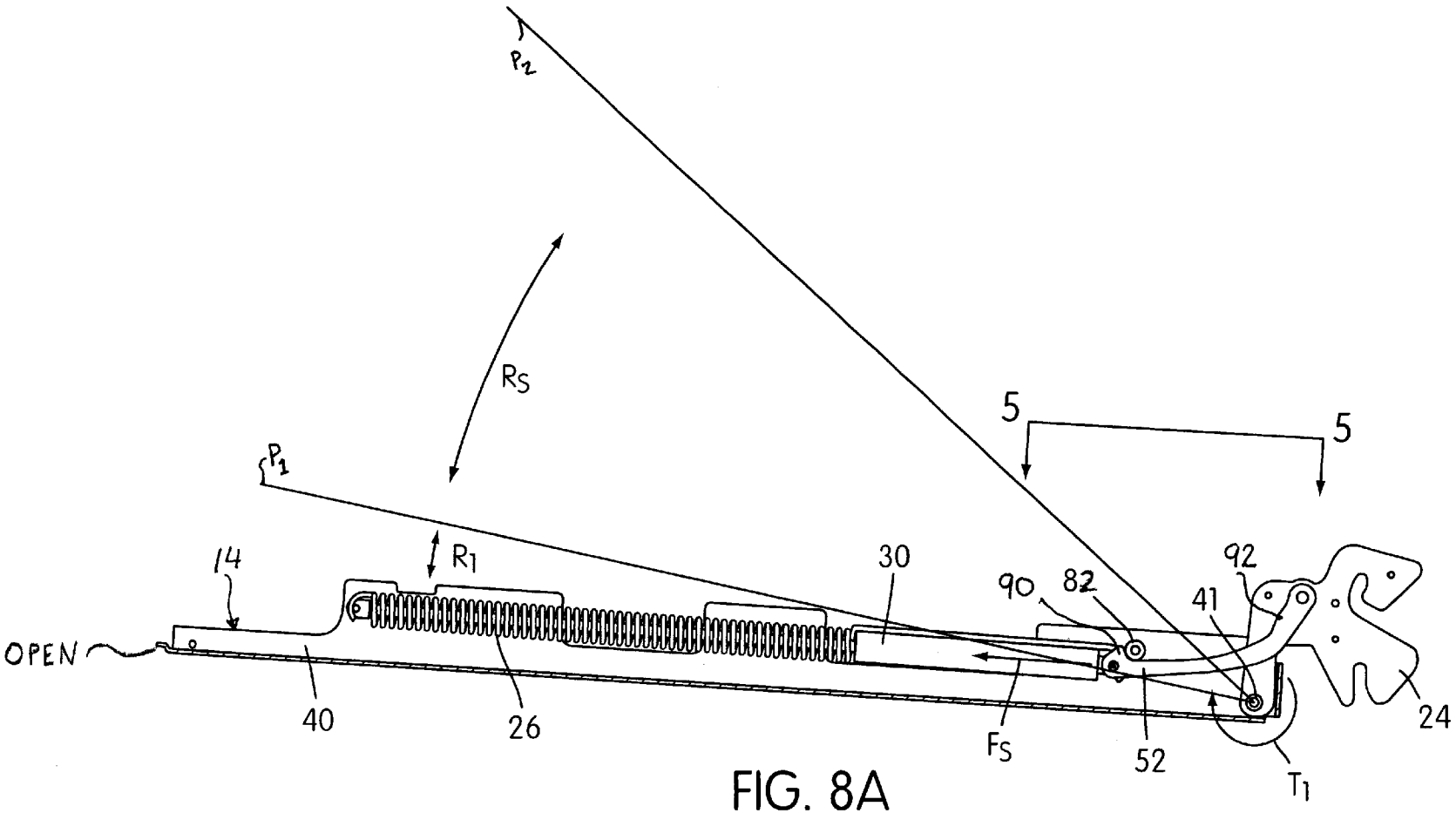
FIGS. 8A–8D are sectional views similar to that shown in FIG. 4, illustrating the various positions and ranges of movement of the door mounting assembly.

As described above, the relative pivotal movement between the oven door assembly 14 (or the door mounting structure 40) and the oven assembly 12 (or the mounting member 24) may be defined by at least three movement ranges (R1–R3), and preferably five ranges of movements ($R_1$–$R_4$ and $R_S$), as shown in FIGS. 8A–8D. FIG. 8A shows the door mounting structure 40 in a position corresponding to the open position of the door assembly 14 (also see FIG. 1). In this position, the door mounting structure 40 and the oven door assembly 14 are disposed in a generally horizontally extending position. The journal member 84 engages stop member 90 to prevent further pivotal movement of the door mounting structure 40. It is noted that it may be preferable for the oven door assembly 14 to be disposed between about 0° and about 5° from horizontal when in the open position.

The first range of movement, denoted by R1 in FIG. 8A, is defined by the pivotal movement of the door mounting structure 40 (similarly, the oven door assembly 14) between the open position (between about 0° and about 5° from horizontal, as described above) and a first intermediate position $P_1$ (at about 10° from horizontal) relative to the mounting member 24 (similarly, the oven assembly 12). During movement of the door mounting structure 40 within the first range of movement R1, the spring force Fs produces a torque T1 about the pivotal connection 41 that acts between the mounting member 24 and the door mounting structure 40 in a direction towards the closed position. In this range R1, however, the weight of the door assembly 14 is sufficient to effect downward movement of the door assembly 14 (including the door mounting structure 40) for any position of the door assembly 14 within this range, against the spring force $F_s$. As such, the door assembly 14 will move into the open position within the range R1 without further manual input.

FIG. 8A also shows an intermediate, static range of movement $R_S$, which exists from about 10° from horizontal (Position $P_1$ in FIG. 8A) to about 42° from horizontal. Generally, in this range $R_S$, the spring biased mechanism 26 induces a torque T2 between the door mounting structure 40 and the mounting member 24 towards the closed position about the pivotal connection 41 that is relatively equal to the force applied to the door assembly 14 by the weight thereof toward the open position. As such, the combination of damping and friction within the system enables the door assembly 14 to maintain a static position when in this range. In other words, the door assembly 14 will remain wherever it is manually moved. The door assembly 14 may be moved out of this static range by manual movement thereof toward either of the open or closed positions of the door assembly 14. For example, the door assembly 14 will be biased in the closing direction under the force of spring biased mechanism 26 once it is manually moved out of the intermediate static range $R_S$ toward the closing direction.

Figure 8B:
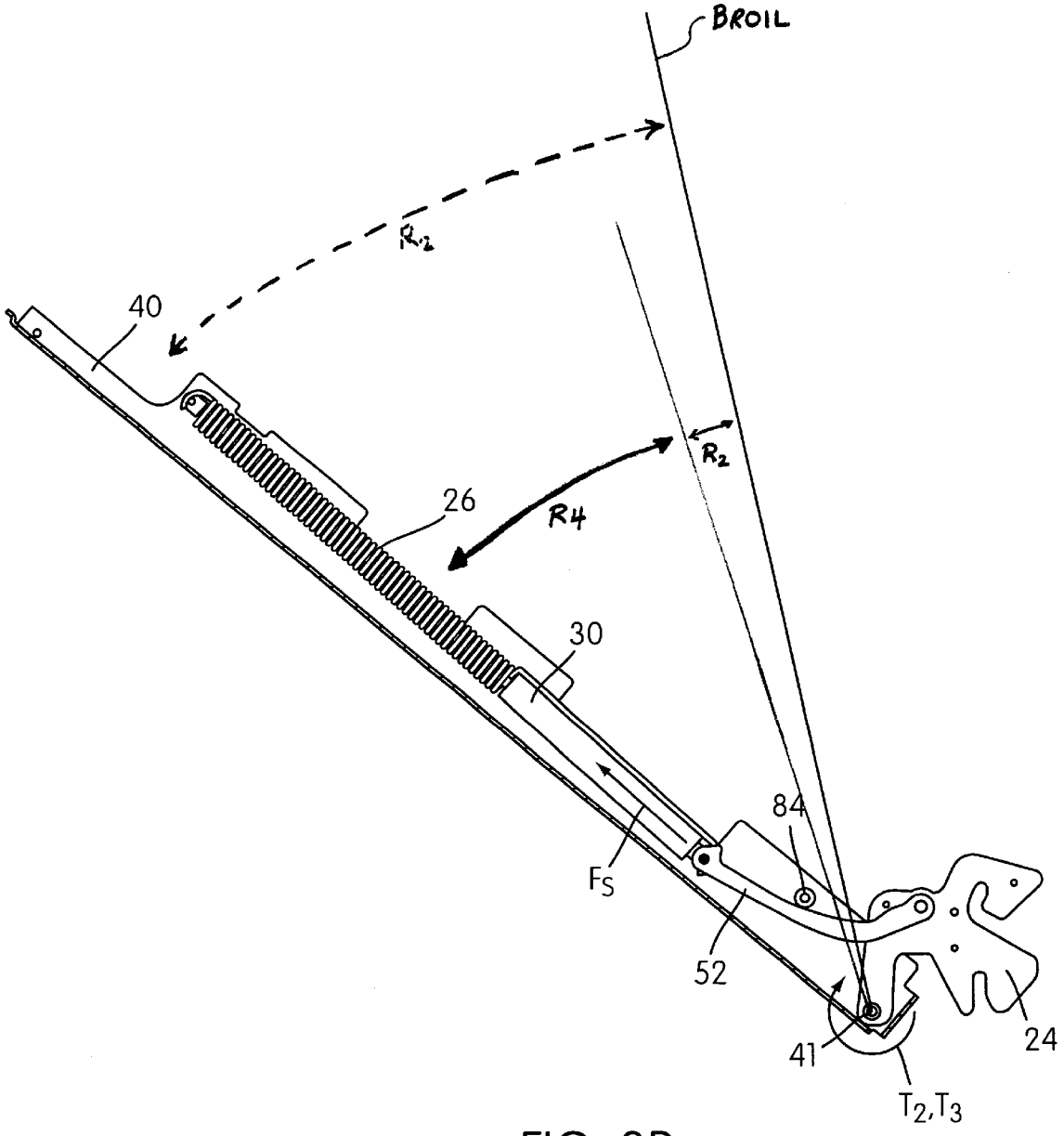

FIG. 8B illustrates a second range of movement, denoted by R2 (in solid lines), of the door assembly 14 (as well as the door mounting structure 40), which range of movement is adjacent the broil position. Within the second range of movement R2, the spring force Fs generated by the spring biased mechanism 26 induces a torque T3 (between the door mounting structure 40 and the mounting member 24) that affects movement of the door assembly 14 (including the door mounting structure 40) toward and into the broiling operating position, shown in FIG. 8C. When the door assembly 14 is manually released within range $R_2$, the door assembly will move toward and into the broiling position, where it will then remain. The second range of movement R2 in this embodiment is preferably between about 14° and 20° from the closed baking position. As will be discussed below, this preferred embodiment also provides a Fourth range of movement R4 that will cause the door assembly 14 to "roll through" the broil position when the door is released within this range. As will also be discussed, an alternate embodiment may be provided with a much larger $R_2$ range and without the $R_4$ range (as illustrated in dashed lines in FIG. 8B).

Figure 8C:
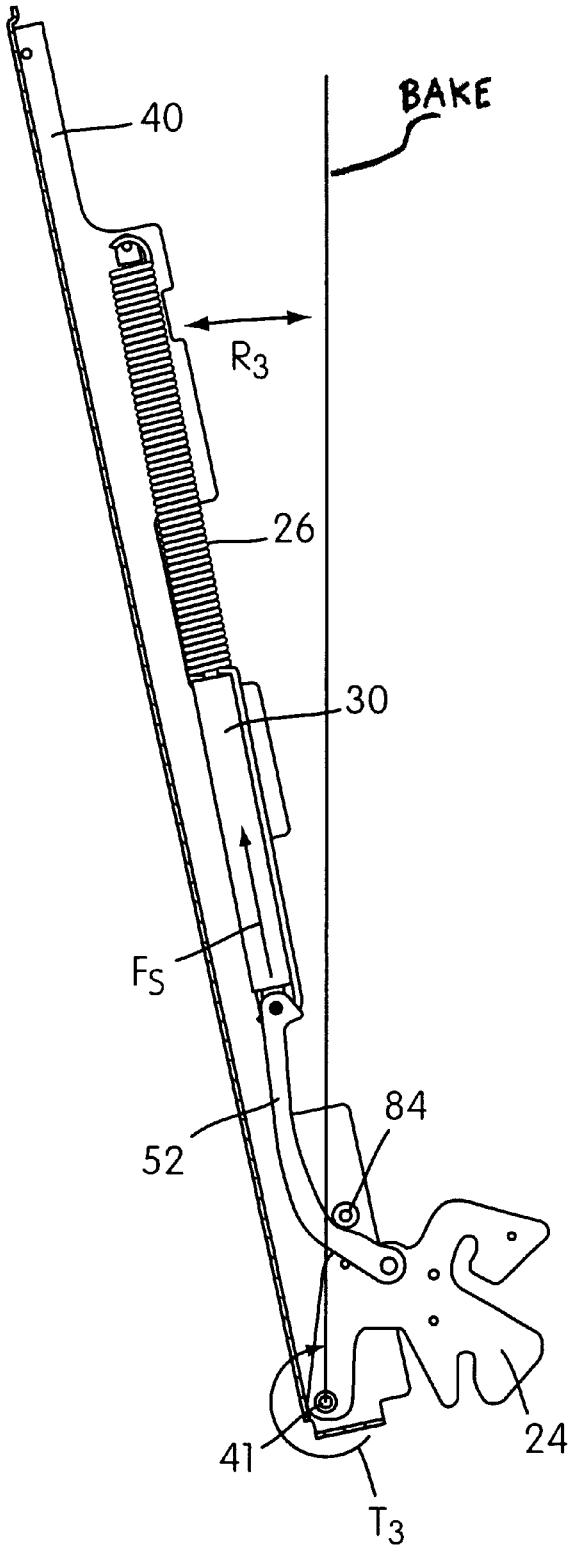
Figure 8D:
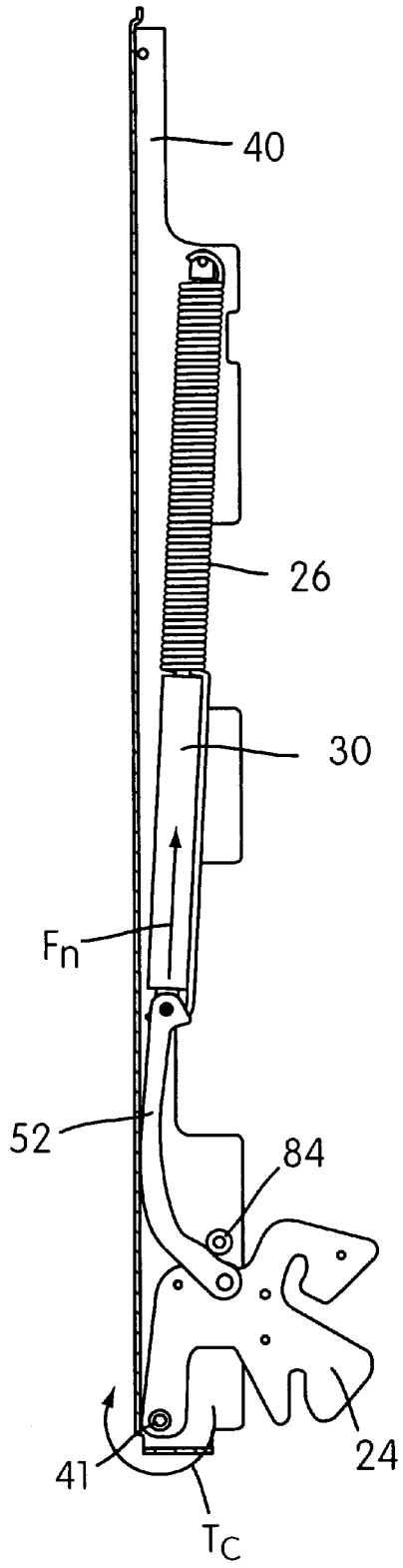

FIG. 8C shows the door assembly 14 in the broiling operating position (approximately 15° from the closed position—also see FIG. 2) and illustrates a third range of movement, denoted by R3, of the door assembly 14 from the broiling operating position toward and into the closed baking operating position (shown in FIG. 8D). Preferably, the range R3 is between about 14° and 0° from the closed baking position.

Figure 10:
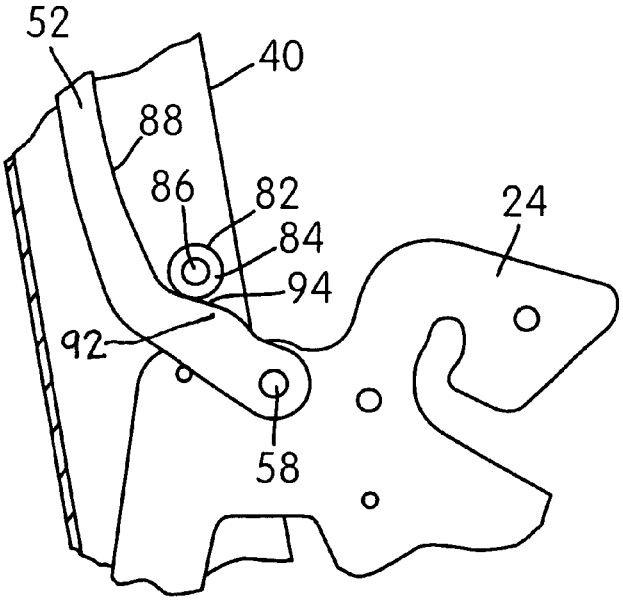
FIG. 10 is a partial side view showing the relationship of the roller element and connecting structure with the door mounting structure in the broiling operating position.

The broiling position is provided by the engagement between the detent portion 92 of the connecting structure 52 and the roller element 82 (see FIG. 10). As shown on FIG. 8C, the roller element 82 (more specifically, the journal member 84) engages a first edge 94 of the detent portion 92, effectively ceasing movement of the oven door assembly 14 toward the closed position and affecting the broiling position, as shown. The detent portion 92 acts as a stop preventing the roller element 82 from passing thereover.

In an alternate embodiment (referring to FIG. 8B), it is contemplated that the detent portion 92 may be configured in conjunction with the damper assembly 30 such that contact between the roller element 82 and the detent portion 92 ceases movement of door assembly 14 when the door assembly 14 is manually moved past the range of movement Rs in the closing direction and then immediately released. In other words, it is contemplated that the door assembly can be manually moved to an angle slightly greater than the $R_S$ region from horizontal (e.g., more than 42° from horizontal) and the damper assembly 30 will have sufficient damping so that detent portion 92 and roller element 82 will act to cease door movement at the broil position. In this embodiment, it can be appreciated that the R2 range (illustrated in dashed lines) can be considered much larger than the preferred range noted above.

However, in accordance with the preferred embodiment, when the door is disposed slightly beyond the static range $R_S$ (e.g., more than 42° from horizontal), it is considered to be within a Fourth range of movement $R_4$. In the preferred embodiment, when the door is manually released (from static) within range $R_4$, the momentum of the door assembly 14 towards the closed position causes roller element 82 to pass over the detent portion 92 without cessation of movement of the door assembly 14 at the broil position. In other words, the door assembly 14 moves toward and into the broil position, and then beyond the broil position without stopping at the broiling position. Of course, if the door assembly 14 is released when positioned closer to the broil position (e.g., within the range R2 of about between 14° and 20° from closed), then the door will stop at the broil position. Preferably, the range $R_4$ is about from 42° from horizontal until the beginning of the $R_2$ range (e.g., about 20° from vertical). In other words, if the door is released from static at anywhere from between 43° to horizontal to about 69° to horizontal (or from about 47° to vertical to about 21° to vertical), the door will roll past broil into the bake position.

It can be appreciated that force inherently acting on the door assembly 14 due to the weight thereof toward the open position decreases as the door assembly becomes relatively more vertically disposed. A relatively greater amount of the weight of the door assembly 14 is carried by the pivotal connection 41. Conversely, a relatively greater amount of the weight acts on the door assembly 14 in the direction toward the open position. As such, when moved from the static region $R_S$ and then released, the weight of the door assembly 14 will either move the door to the fully opened position, or the spring biased mechanism 26 affects movement of the door to the closed position.

In prior oven door hinges, the momentum of the oven door increased as it moved toward the closed position and, if left unchecked (i.e., not manually moved into the closed position) would impact the oven with an undesirably large force. Impact damage to the door and oven, as well as prolonged fatigue wear often occurred. However, the damper assembly 30 of the door mounting assembly 22 serves to limit the rate of movement (velocity) of the door assembly 14 through this range of motion, thereby limiting the momentum thereof. The door assembly 14 maintains a controlled, relatively slow rate of movement through the range R2 toward or through the broiling position (from $R_4$) and prevents impact and/or fatigue damage to the oven door assembly and oven assembly.

The range R3 of movement is also controlled by the damper assembly 30, as the door assembly 14 moves from (or through) the broiling position (shown in FIG. 8C) toward and into the closed baking operating position, shown in FIG. 8D (also see FIG. 3). The arrangement of the door mounting structure 40, as shown in FIG. 8D, corresponds to an arrangement between the door assembly 14 and the oven assembly 12, wherein the door assembly 14 abuts the oven assembly 12 to effectively enclose the oven chamber 16, as shown in FIG. 3. The closed position of the door assembly 12 limits heat loss from the oven chamber 16, so as to prevent injury to users and efficiently heat items within the oven chamber 16.

The oven door assembly 14 may further include an annular heat seal (not shown) to further limit heat loss between the door and oven assemblies 14, 12. As such, the connecting structure 52 is constructed and arranged to affect a deflected state of the spring biased mechanism 26 as the door assembly 14 moves into the closed position thereby maintaining a closure force on the door assembly 14 to sufficiently engage the heat seal with the oven assembly 12. To initiate and maintain the deflected state of the spring biased mechanism 26, the roller element 82 is made to ride over the first edge 94 of the detent portion 92 as the door assembly nears the closed position. When in the closed position, the roller element 82 engages the detent portion 92 at an apex thereof (see FIG. 9), thereby maintaining a tensive residual force, denoted Fr in FIG. 8D, in the spring biased mechanism 26 when the door assembly 14 is in the closed position thereof. The residual spring force Fr, in effect induces a closure torque Tc about the pivotal connection 41, thereby maintaining sufficient engagement of the heat seal between the door assembly 14 and the oven assembly 12.

From the closed position, shown in FIG. 3, the oven door assembly 14 may be manually moved (against the bias of the spring biased mechanism 26) toward or into either of the broiling operating position (see FIG. 2) or the open position (see FIG. 1). It may be preferable for the user to effect the manual movement of the door assembly by pulling the handle 28 outwardly, thereby pulling the door assembly 14 outwardly, as well. The handle 28 allows the user to safely (by being spaced from the potentially hot door assembly and/or oven assembly) and positively (by providing an easily grippable structure) control movement of the door assembly 14.

Figure 9:
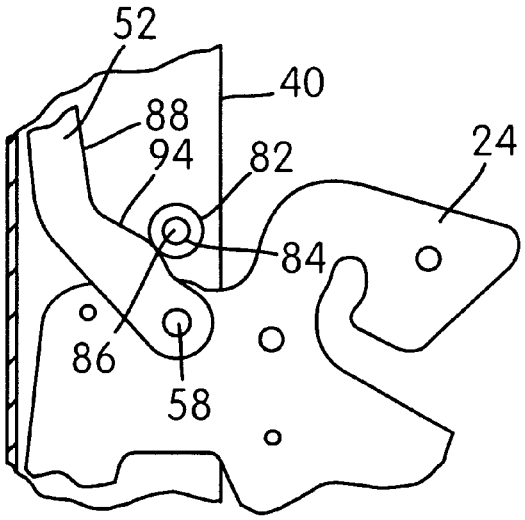
FIG. 9 is a partial side view showing the relationship of the roller element and connecting structure with the door mounting structure in the closed baking operating position.

As the door assembly 14 (door mounting structure 40) moves from the closed position toward the broiling position, the roller element 82 moves from the apex of the detent portion 92 and rides along the first edge 94 of the detent portion 92, as shown in FIGS. 9 and 10. The door assembly 14 may then be manually moved through the range R3 into the broiling position, where the user may cease manual movement (allowing the door assembly 14 to remain in the broiling position) or may continue manual movement of the door through range R2. It is noted that the damper assembly 30 is preferably configured so as to allow undamped movement of the door assembly 14 in the direction from the closed (or broiling) position toward the open position. As such, the damper assembly 30 does not add significant resistance to manual movement of the door assembly 14 in this direction. Consequently, resistance to the manual movement is minimized in this direction.

As described previously, the door mounting assemblies 22 are configured such that the spring biased mechanism 26 affects movement of the door assembly 14 (toward the closed—or broiling—position) when the door assembly 14 is disposed within either of the ranges R2 or R3. As such, upon release of manual control of the movement of the door assembly 14 within ranges R2 or R3, when opening (or closing—described above) the door assembly 14, the door assembly 14 will be moved toward the closed or broiling position by the spring force of the spring biased mechanism 26.

Upon reaching the static range of movement $R_S$, described above and shown in FIG. 8B, the user may cease manual movement of the door assembly 14, at which point the door assembly 14 will maintain its position. However, the user may also continue manual movement of the door assembly 14 through the static position. Upon reaching the range of movement R1, the weight of the door assembly acting toward the open position reaches a sufficient magnitude to overcome the spring force Fs and affect movement of the door assembly 14.

While the principles of the invention have been made clear in the illustrative embodiments set forth above, it will be obvious to those skilled in the art to make various modifications to the structure, arrangement, proportion, elements, materials and components used in the practice of the invention.

It will thus be seen that the aspects of this invention have been fully and effectively accomplished. It will be realized however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. An oven comprising:

an oven assembly defining an oven chamber within which heatable items can be heated, said oven chamber having an access opening communicating therewith, an oven door assembly mounted on said oven assembly for movement between (1) a generally vertically extending closed baking operating position enabling heatable items disposed in said oven chamber to be heated with said access opening closed (2) a slightly inclined partially open broiling operating position enabling heatable items in said oven chamber to be broiled and (3) a generally horizontally extending open position enabling heatable items to be moved into and out of said oven chamber through said access opening;

said oven door assembly defining substantially enclosed spaces within opposite ends thereof, a pair of horizontally spaced door mounting assemblies extending within said spaces, each of said door mounting assemblies including a mounting member extending from an associated one of said spaces and detachably fixedly secured to said oven assembly and pivotally connected to said door assembly enabling said door assembly to be pivotally moved with respect to said oven assembly between said operating positions and said open position thereof, each of said door mounting assemblies including a spring biased mechanism within an associated one of said spaces constructed and arranged to enable said oven door assembly (1) to be biased by the weight thereof toward and into the open position thereof when in a first range of movement adjacent said open position (2) to be biased toward and into said broiling position by said spring biased mechanism when in a second range of movement adjacent the broiling position thereof and (3) to be biased toward and into said baking position by said spring biased mechanism when in a third range of movement adjacent said baking position, a manually engagable structure on said oven door assembly constructed and arranged to enable a user to manually control movement of said oven door assembly within all of said ranges, said pair of door mounting assemblies including a damper assembly within an associated one of said spaces that provides resistance to the movement of said oven door assembly within said second and third ranges to limit the rate of movement of the oven door assembly toward said broiling and baking positions by manual movement or under the bias of said spring biasing mechanism allowed as a result of the release of manual control.

2. An oven according to claim 1, wherein each of said door mounting assemblies include a respective damper assembly.

3. An oven according to claim 1, wherein only one of said mounting assemblies includes said damper assembly.

4. An oven according to claim 1, wherein said spring biased mechanism biases said oven door assembly toward said broiling position and through said broiling position into said baking position when said door assembly is released from a fourth range of movement beyond said second range in spaced relation to said third range.

5. An oven according to claim 1, wherein each of said door mounting assemblies includes a door mounting structure securely fixable with said oven door assembly, said door mounting structures being pivotally connectable with said mounting members of respective door mounting assemblies.

6. An oven according to claim 5, wherein each of said door mounting assemblies further includes a connecting structure, said connecting structures being pivotally connectable at one end thereof with said mounting members of respective door mounting assemblies.

7. An oven according to claim 6, wherein one end of each of said spring biased mechanisms is connectable at one end thereof with said connecting structures of respective door mounting assemblies, said spring biased mechanisms being connectable at an opposite end thereof with respective door mounting structures.

8. An oven according to claim 7, wherein said damper assembly has one end thereof connectable with one of said connecting structures of said door mounting assemblies, said damper assembly being connectable at an opposite end thereof with a respective door mounting structure.

9. An oven according to claim 8, wherein each of the door mounting structures includes a roller element that is rollingly engagable with respective connecting structures.

10. An oven according to claim 8, wherein said spring biased mechanism is a tension spring.

11. An oven according to claim 10, wherein said spring biased mechanism includes an elongated cylindrical coiled portion, said coiled portion defining a longitudinally extending inner opening.

12. An oven according to claim 11, wherein said damper assembly includes an elongated damper body and a damper rod, said damper rod extendable from and retractable into said damper body.

13. An oven according to claim 12, wherein said spring biased member and said damper assembly coaxially extend between said connecting structure and said door mounting structure such that said damper rod extends within said longitudinally extending inner opening of said coiled portion.

14. An oven according to claim 1, wherein said oven door assembly is disposed between about 0° and 5° from horizontal when in said generally horizontally extending open position.

15. An oven according to claim 14, wherein said oven door assembly is disposed at about 15° from vertical when in said slightly inclined partially open broiling operating position.

16. An oven according to claim 15, wherein said first range of movement of said oven door assembly includes movement of said oven door assembly between said generally horizontally extending open position and about 10° from horizontal.

17. An oven according to claim 16, wherein said second range of movement of said oven door assembly includes movement of said oven door assembly between about 42° from horizontal and said broiling position.

18. An oven according to claim 1, wherein said door mounting assemblies include a detent mechanism that enables said door assembly to stop at said broiling position when said door assembly is released from said second range of movement.

19. An oven according to claim 4, wherein said second range of movement of said oven door assembly includes movement of said oven door assembly between about 20° from vertical and the broiling position.

20. An oven according to claim 19, wherein said fourth range of movement of said oven door assembly includes movement of said oven door assembly between about 42° from horizontal and about 20° from vertical.

21. An oven according to claim 20, further comprising a range of movement for which the door will remain static when manually released in a static condition.

22. An oven according to claim 21, wherein said range of movement for which the door will remain static is about 10° from horizontal to about 42° from horizontal.

23. An oven according to claim 1, wherein said damper assembly having structure to provide more resistance to the movement of said oven door assembly in a direction toward said baking position than in a direction toward said open position.

24. A damped oven door mounting assembly connectable between an oven assembly and an oven door assembly, said damped oven door mounting assembly comprising:

a pair of horizontally spaced door mounting assemblies adapted to be disposed within an oven door assembly;

each of said door mounting assemblies including a mounting member adapted to extend from the oven door assembly and be detachably fixedly secured to the oven frame assembly and pivotally connected to said door mounting assembly enabling the oven door assembly to be pivotally moved with respect to the oven assembly between (1) a generally vertically extending closed baking operating position (2) a slightly inclined partially open broiling operating position and (3) a generally horizontally extending open;

each of said door mounting assemblies including a spring biased mechanism connectable between said mounting member and said door mounting assemblies constructed and arranged to enable the oven door assembly (1) to be biased by the weight thereof toward and into the open position thereof when in a first range of movement adjacent the open position (2) to be biased toward and into the broiling position by said spring biased mechanism when in a second range of movement adjacent the broiling position thereof and (3) to be biased toward and into the baking position by said spring biased mechanism when in a third range of movement adjacent the baking position, said pair of door mounting assemblies including a damper assembly constructed and arranged to provide resistance to the movement of the oven door assembly within the second and third ranges to limit the rate of movement of the oven door assembly toward the broiling and baking positions while providing substantially less resistance to the movement of the oven door assembly away from the baking position and toward the open position.

* * * * *